US006110041A

United States Patent [19]

Walker et al.

[11] Patent Number: 6,110,041

[45] Date of Patent: Aug. 29, 2000

[54] METHOD AND SYSTEM FOR ADAPTING GAMING DEVICES TO PLAYING PREFERENCES

[75] Inventors: Jay S. Walker, Ridgefield; James A. Jorasch, Stamford; Thomas M. Sparico, Riverside, all of Conn.

[73] Assignee: Walker Digital, LLC, Stamford, Conn.

[21] Appl. No.: 08/775,388

[22] Filed: Dec. 30, 1996

[51] Int. Cl.[7] ..... A63B 71/00

[52] U.S. Cl. ..... 463/20; 463/42; 273/139

[58] Field of Search ..... 463/16, 20, 30, 463/40, 41, 42, 29, 25, 26, 27, 28; 345/112, 127, 133; 235/786, 886; 273/143 R, 292, 293, 139, 138.2; 700/91, 92, 93

[56] References Cited

U.S. PATENT DOCUMENTS

| | | | |
|---|---|---|---|
| 4,764,666 | 8/1988 | Bergeron | 463/17 |
| 4,880,237 | 11/1989 | Kishishita | 463/20 |
| 5,132,900 | 7/1992 | Gilchrist et al. . | |
| 5,459,825 | 10/1995 | Anderson et al. . | |
| 5,546,523 | 8/1996 | Gatto . | |
| 5,561,811 | 10/1996 | Bier . | |
| 5,741,183 | 4/1998 | Acres et al. | 463/16 |
| 5,770,533 | 6/1998 | Franchi | 463/16 |
| 5,779,549 | 7/1998 | Walker et al. | 463/42 |
| 5,816,917 | 10/1998 | Kelmer et al. | 463/16 |

OTHER PUBLICATIONS

Microsoft Windows "Solitaire" screen images, 1981.

D. Sherman, "Company Launches New Player Tracking System," The Reuter Asia–Pacific Business Report, Oct. 20, 1995.

K. Berry, "Anchor Gaming, Inc.", Investor's Business Daily, The New America section, p. A6, May 2, 1996.

S. Franklin, "Pinball Power Puts Money Into the Slots," Chicago Tribune, Business Section, p. 1, May 9, 1994.

J. Salmon–Heyneman, "Gaming Propels Fastest Growing Publicly Traded Firms in Valley," Las Vegas Business Press, vol. II, No. 27, Sec. 1, p. 11, Jul. 11, 1994.

J. Mattox, "Huntington Press: Publishing the Books on Las Vegas," Las Vegas Business Press, vol. 13, No. 51, p. 3, Sep. 16, 1996.

T. Troy, "Flexibility a Key for Vendors Betting on Casinos; Micros Systems Inc.'s 8700 Point–of–Sale System," Hotel & Motel Management, vol. 209, No. 16, p. 27, Sep. 19, 1994.

J. Grochowski, "Casino Insider Offers a Guide to Freebies," Chicago Sun–Times, Weekend Plus section, p. 31, Aug. 12, 1994.

J. Grochowski, "Riverboat Comp Systems: Cracking a Case in Point," Chicago Sun–Times, Weekend Plus section, p. 13, Mar. 17, 1995.

T. Troy, "High Stakes Technology; Technology for Guest Retention Management," Hotel & Motel Management, vol. 209, No. 16, p. 27, Sep. 19, 1994.

R. Murray, "Casinos Gamble on Direct Mail; Atlantic City Casinos; Retail; Industry Overview," Direct Marketing Magazine, vol. 54, No. 10, p. 32, Feb. 1992.

J. Grochowski, "Comp Points Add Up Faster Playing Slots," Chicao Sun–Times, Weekend Plus Section, p. 23, Nov. 8, 1996.

D. Freedman, "Odds Man In," Forbes, Quick Studies section, p. 33, Oct. 25, 1993.

B. Kent, "New Boardwalk Barter; Atlantis Introduces a Token as Enticement," The Record, Lifestyle section, p. 32, Jul. 22, 1988.

H. Fisher, "Casino Law Ends Cash Rebates for Big–Time Losers," The Record, News section, p. A05, Jan .15, 1988.

"Casino's Computers Keep Tabs on Losers," The Chicago Tribune, Business section, p. 14, Oct. 2, 1988.

*Primary Examiner*—Valencia Martin-Wallace
*Assistant Examiner*—John Paradiso
*Attorney, Agent, or Firm*—Steven M. Santisi; Dean Alderucci

[57] ABSTRACT

A slot machine networked to a central server receives preference data corresponding to a player from the central server and configures the game to match the received preference data. The player inserts his player tracking card into the slot machine, which transmits player identification data to the central server. The central server transmits player preference data and casino preference data for that player to the slot machine for configuration. While the player plays the slot machine, the slot machine transmits data about the player's performance to the central server. The central server determines appropriate casino preference values based upon the player's performance and transmits those values to the slot machine for configuration.

43 Claims, 13 Drawing Sheets

214

| PLAYER ID | SOCIAL SECURITY NUMBER | NAME | ADDRESS | CREDIT CARD NUMBER | PLAYER RATING | COMP. INFO | PLAYER PREFERENCE TRACKING NUMBER | CASINO PREFERENCE TRACKING NUMBER |
|---|---|---|---|---|---|---|---|---|
| JJ-3467 | 123-45-6789 | PLAYER A | XXX ST. XX, XX 12345 | 1111 2222 3333 4444 | HIGH ROLLER | FREQUENT COMP. RATE | HR-112 | CHR-112 |
| | | | | | | | | |
| | | | | | | | | |

FIG. 4

216

| PLAYER ID NO. | TRACKING NUMBER | GAME TYPE | LANGUAGE | SOUND OPTIONS | SPEED OF REEL SPINS | NUMBER OF COINS PLAYED AS DEFAULT | PAYOUT STRUCTURE | PAYOUT OPTIONS | FORM OF COMP. | CURRENCY |
|---|---|---|---|---|---|---|---|---|---|---|
| PLAYER ID NO. 12345 | HR-234 | VOLCANO ISLAND 2 COIN SLOT | FRENCH | MEDIUM | FAST: 110/MIN | 2 | ONLY HIGH END JACKPOTS | AT END OF PLAY | DRINKS | U.S. DOLLARS |
| PLAYER ID NO. 23456 | ACES-567 | VIDEO POKER-JACKS & UP | ENGLISH | LOUD | MEDIUM: 5 HANDS/ MINUTE | 3 | | WITH EACH HAND PLAYED | MEALS OR T-SHIRTS | U.S. DOLLARS |
| PLAYER ID NO. 34567 | | | | | | | | | | |

FIG. 5

218

| PLAYER ID NO. | HOLD PERCENTAGE | COMP. RATE | COMP. AWARD LIMITS | GAME ELIGIBILITY (LOCKOUT) | OTHER |
|---|---|---|---|---|---|
| PLAYER ID NO. 12345 | 5% | ONE EVERY THREE HOURS | ONLY DRINKS | ALL | |
| PLAYER ID NO. 23456 | 10% | ONE EVERY HOUR | ONLY DRINKS OR MEALS | LEVEL 3 | |
| PLAYER ID NO. 34567 | 7.5% | ONE EVERY DAY | NONE | NONE | |

FIG. 6

326

| GAME TYPE | LANGUAGE | SOUND | SPEED OF REEL SPIN | CURRENCY | PAYOUT TYPE | PAYOUT STRUCTURE | NO. OF COINS (DEFAULT) | FORM OF COMP. |
|---|---|---|---|---|---|---|---|---|
| 1 | A | X | 10 | $ | A1 | CUSTOM1 | 1 | MONEY |
| 2 | B | XX | 9 | LBS. | A2 | CUSTOM2 | 2 | FOOD |
| 3 | C | XXX | 8 | YEN | A3 | | 3 | DRINK |
| 4 | D | XXXX | 7 | DM | A4 | | 4 | ROOM |
| 5 | E | XXXXX | 6 | PESO | A5 | | 5 | MERCHANDISE |
| 6 | F | XXXXXX | 5 | | A6 | | 6 | FREQ. FLYER MI |
| 7 | G | XXXXXXX | 4 | | A7 | | 7 | COUPONS |
| 8 | H | XXXXXXXX | 3 | | A8 | | 8 | CREDITS |
| 9 | I | XXXXXXXXX | 2 | | A9 | | 9 | TICKETS |

FIG. 7

328

| HOLD PERCENTAGE | COMPLIMENTARY RATE | COMP. SPECIFICATIONS | GAME ELIGIBILITY (LOCKOUT) | OTHER |
|---|---|---|---|---|
| 5.75% | ONE EVERY 80 MINUTES OF PLAY | DRINKS AND FOOD ONLY | NONE | DOES NOT LIKE CHINESE FOOD |
| 7.65% | ONE EVERY 30 MINUTES OF CONTINUOUS PLAY | MERCHANDISE/ROOM | LEVEL 4 | PREFERS MARTINIS |
| | | | | |
| | | | | |

FIG. 8

METHOD AND SYSTEM FOR ADAPTING GAMING DEVICES TO PLAYING PREFERENCES

RELATED APPLICATIONS

This invention claims priority to U.S. Pat. No. 5,779,549 filed Apr. 22, 1996 and issued Jul. 14, 1998 to Walker et al. entitled "Database Driven Online Distributed Tournament System".

BACKGROUND OF THE INVENTION

1. Field of the Invention

The present invention relates to gaming methods and systems. More particularly, the present invention relates to a method and system for adapting gaming devices to playing preferences.

2. Description of the Related Art

Many casinos offer electronic slot machines, each programmed to play a particular game of chance, such as slots, video poker, or video blackjack. While these games award payouts based upon play results, they are designed to retain, on average, a certain percentage of all money received. This percentage is commonly referred to as the "hold percentage." Despite the fact that the odds are stacked in favor of slot machines, players still play slot machines not only for their entertainment value, but also in hopes of winning a large jackpot.

To provide an added incentive to play the slot machines, many casinos offer programs to reward those players who frequently play slot machines. In one such program, a casino accumulates "player reward points" for a player as he spends money on slot machines in that casino. This can be done by networking the slot machines to a central server that stores the points for that player. The casino issues a player tracking card containing a unique player identification number. The player inserts the card into a card reader of a slot machine, which transmits the identification number to the central server. As the player spends money in the slot machine, the server accumulates reward points for that player. After the player accumulates enough points, he can redeem them for, for example, merchandise or apply them against room, food, and beverage charges at the casino hotel.

In many cases, however, these incentives may not be enough to attract casino players to play slot machines. One reason is that players may find it difficult to locate slot machines configured to play the game they prefer. A slot machine is typically programmed to play a single game type (e.g., deuces-wild, video poker). If a player is interested in playing a game other than the game that a particular slot machine is programmed to play, he is forced to wander around the casino until he is able to locate another available slot machine programmed to play the preferred game. In addition, where a group of people visit a casino, members of the group may be forced to split up so that each can find a slot machine programmed to play the game he likes.

Even after players have successfully found slot machines programmed to play the games they like, those slot machines may not be configured to operate in a manner that they like. For example, many slot machines do not permit players to select which language is used, or choose which form of payout (i.e., money, prize, complimentary awards) the player prefers. Thus, locating slot machines configured to players' preferences presents such an imposing task that many players are simply discouraged from even trying and consequently do not play slot machines. Accordingly, conventional slot machines do not satisfy the needs of many players.

To address this shortcoming, some slot machines prompt players at the beginning of every gaming session to select from a menu of games. This, however, requires players to spend some time at the beginning of each and every gaming session choosing their preferred game, which in most cases does not vary from session to session. Many players are unwilling to spend, or uninterested in spending, the time to repeatedly enter the same game selection every time they play. Accordingly, such slot machines are also unsatisfactory.

SUMMARY OF INVENTION

Systems consistent with the present invention allow casino players to customize slot machines easily according to their playing preferences and tailor the play of the slot machines for individual players. Such systems also eliminate the need for players to wander around a casino to locate a slot machine configured in the manner they prefer. Moreover, these systems allow slot machines to adapt in order to maintain the interest of the player.

To achieve these and other advantages and in accordance with the purpose of the invention, as embodied and broadly described, a gaming system consistent with the present invention is adaptable to playing preferences and comprises a slot machine for allowing a player to bet on pseudo-randomized events and a central server. The slot machine includes a device for receiving preference data representing a preferred operation of the slot machine and a device for programming the slot machine to operate according to the received preference data. The server includes a device for storing a collection of data representing various operations of the slot machine and a device for selectively transmitting a portion of the stored collection of data to the slot machine as preference data.

A server consistent with the present invention for configuring a slot machine to playing preferences comprises a device for storing a collection of data representing various operations of the slot machine and a device for selectively transmitting a portion of the stored collection of data to the slot machine as preference data.

A game machine configured for use with the present invention and adaptable to playing preferences for allowing a player to bet on pseudo-randomized events controlled by the game machine comprises a device for receiving preference data representing a preferred operation of the game machine from an electronic storage medium and a device for configuring the game machine to operate according to the received preference data.

Both the foregoing general description and the following detailed description are exemplary and explanatory and are intended to provide further explanation of the invention as claimed.

BRIEF DESCRIPTION OF THE DRAWINGS

The accompanying drawings are included to provide a further understanding of the present invention and, together with the Detailed Description, serve to explain the principles of the invention.

In the drawings:

FIG. 4 illustrates a sample record from player database 214 stored in data storage device 210 shown in FIG. 2;

FIG. 5 illustrates a sample record from player preferences database 216 stored in data storage device 210 shown in FIG. 2;

FIG. 6 illustrates a sample record from casino preferences database 218 stored in data storage device 210 shown in FIG. 2;

FIG. 7 illustrates a sample table from game parameter database 326 stored in data storage device 320 shown in FIG. 3;

FIG. 8 illustrates a sample table from casino parameter database 328 stored in data storage device 320 shown in FIG. 3;

FIGS. 11*a*–1*b* are flow diagrams representing a method of configuring a slot machine based upon casino preferences consistent with the invention.

DETAILED DESCRIPTION

Introduction

Systems consistent with the present invention allow casino players to set player parameters easily, such as game type, language, and payout options, to preselected player preferences. In such systems, one or more slot machines are networked to a central server that stores information about player preferences. After a player inserts a player tracking card into a networked slot machine, that slot machine reads and transmits the player's identification number to the central server. The central server accesses and transmits player preferences associated with the received identification number to the slot machine. The slot machine receives the player preferences from the central server and configures the game to operate according to the received player preferences.

The present invention also allows slot machines to modify casino parameters, such as hold percentage, complimentary award rate, and game eligibility, to casino preferences according to the performance of casino players to enhance their play experience. The networked slot machine transmits to the central server a player identification number and performance data for a casino player. The central server receives the player identification number and performance data, determines appropriate casino preferences, and transmits the casino preferences to the slot machine. The slot machine receives the casino preferences from the central server and configures the game to operate according to the received casino preferences.

System

Figure 1:
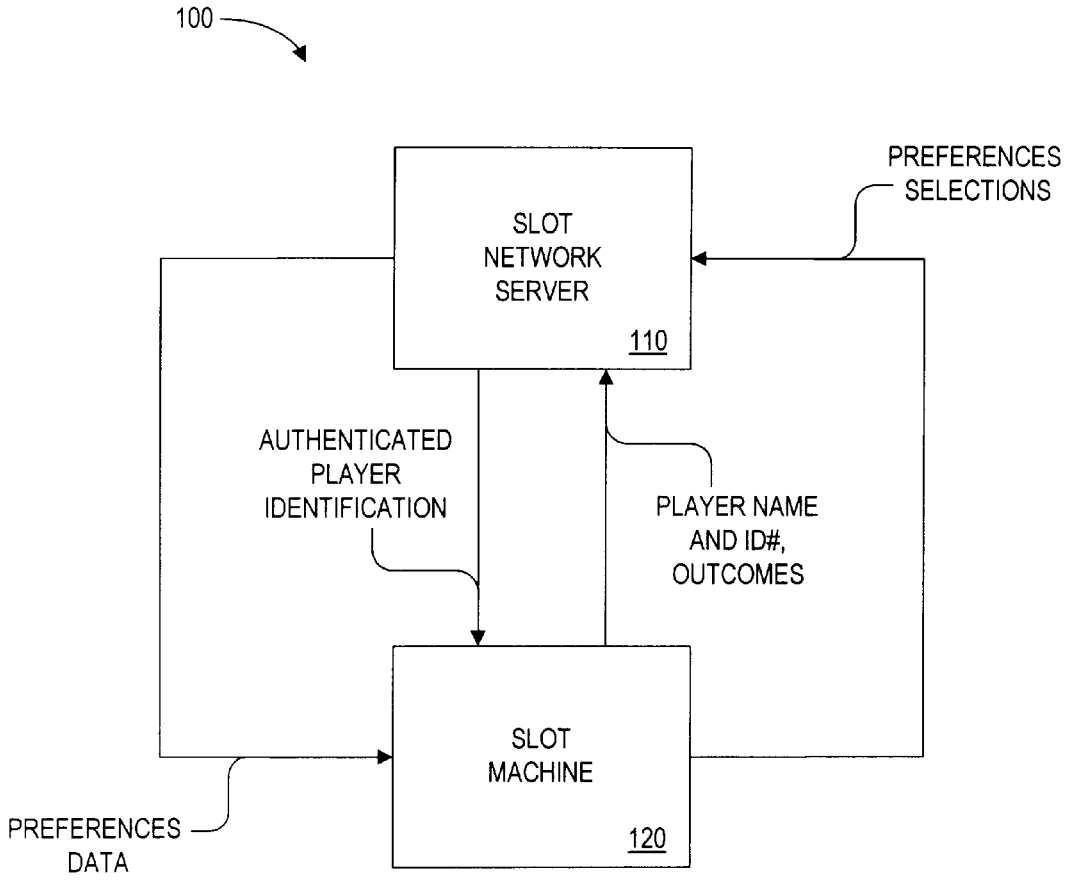
FIG. 1 is a block diagram of the system consistent with the invention.

FIG. 1 illustrates a block diagram of a system 100 consistent with the present invention. System 100 includes slot network server 110 networked with slot machine 120. Although FIG. 1 shows only one slot machine 120, many slot machine are typically connected to network server 110. The term "slot machine" as used in this specification refers to any programmable gaming terminal controlling a random or pseudo-random event in which one or more players can bet on the outcome of the event.

Slot network server 110 may comprise conventional server computer hardware, such as an RS 6000 manufactured by IBM Corp. Server 110 executes software instructing the hardware to execute unique functions and operations in accordance with the principles of the present invention. Slot machine 120 may comprise a conventional slot machine modified to carry out the functions and operations described below.

Slot network server 110 and slot machine 120 transmit digitally encoded data and messages to one another. The transmitted data may represent player name and identification number, play results, authenticated player identification, preferences selections, and preferences data. The communications link between server 110 and slot machine 120 preferably comprises a cable on which electronic signals can propagate. Alternatively, however, the communications link may comprise other conventional communications links, such as over-the-air broadcast transmission.

Figure 2:
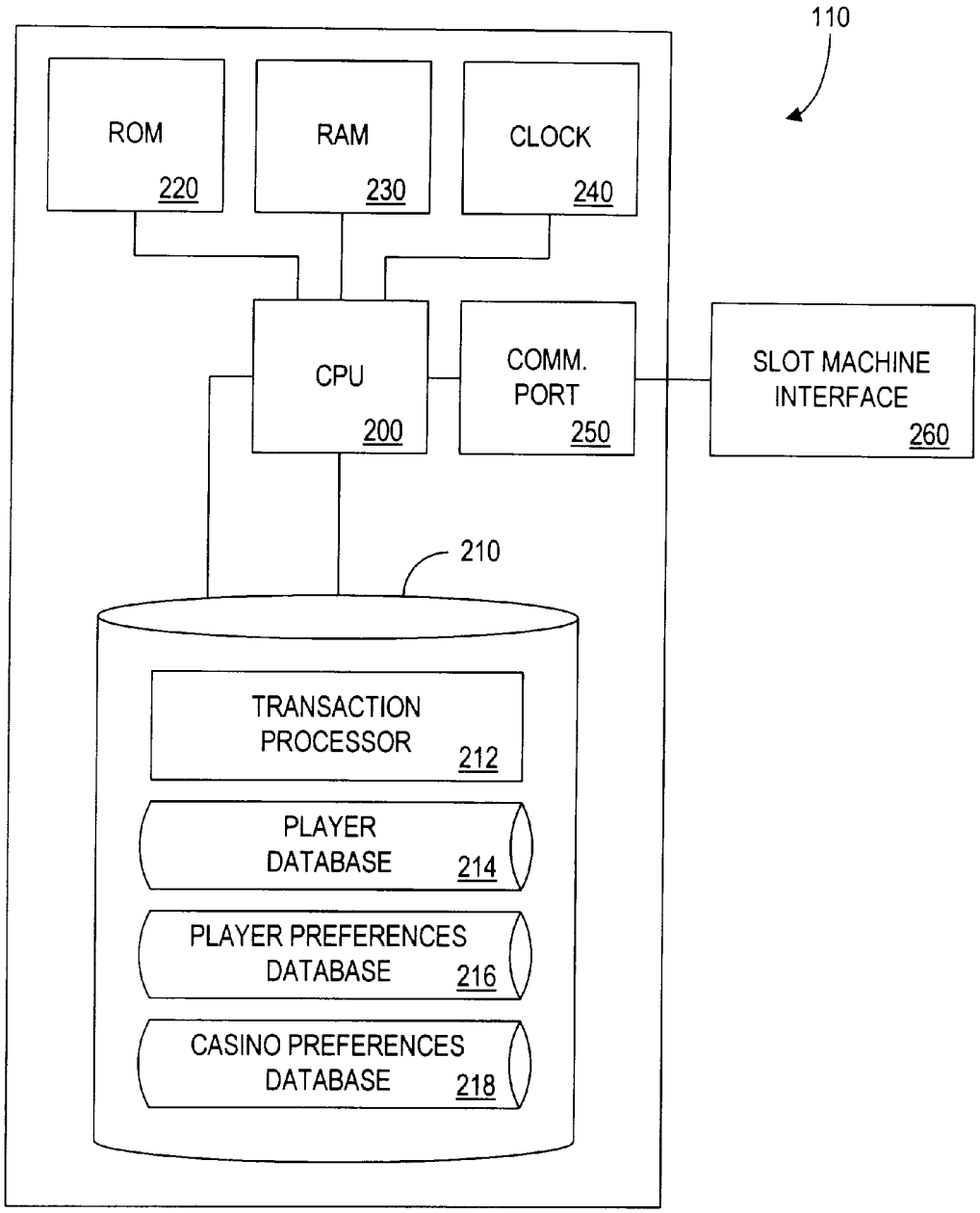
FIG. 2 is a block diagram of slot network server 110 shown in FIG. 1.

FIG. 2 is a block diagram showing the architecture of slot network server 110. Like other conventional server computers, network server 110 includes certain standard hardware components, such as CPU 200, storage device 210, ROM 220, RAM 230, clock 240, communications port 250. CPU 200 is linked to each of the other listed elements. Communications port 250 connects network server 110 to slot machine interface 260, which links network server 110 to slot machine 120.

Unlike conventional servers, however, network server 110 executes one or more programs to perform the functions and operations described below and stores several databases of data relating to those functions and operations. These databases include player database 214, player preferences database 216, and casino preferences database 218. The programs (not shown) are preferably stored in storage device 210 and executed by CPU 200.

Transaction processor 212 accesses information to and from the databases in data storage device 210. Transaction processor 212 may comprise a separate, conventional CPU/microprocessor, as shown in FIG. 2, or alternatively comprise a portion of the operating function of CPU 200.

Player database 214 provides a repository of information on players who received casino player tracking cards. Players preferably receive casino player tracking cards from a casino by registering with the casino's card issuing authority. FIG. 4 shows a possible organization of database 214 with the following information for each registered player: (1) player identification number, (2) social security number, (3) name, (4) address, (5) credit card number, (6) player rating, (7) complimentary (comp.) information, (8) player preference tracking number, and (9) casino preference tracking number. Player rating is preferably assigned by the casino and indicates the level of gambling activity of the player based upon, for example, the amount of money wagered per bet as well as the time played. Complimentary information for each player includes data indicating what free amenities, or "complimentaries," the casino has granted to the player as a reward for playing at the casino. Such amenities may include, for example, free drinks and meals at the casino, or a free room for the night in the casino hotel, or discounts for performances. Player preference tracking number and casino preference tracking number are unique identification numbers used to track the playing preferences of a player internally. In some embodiments, use of these tracking numbers may not be necessary. Player database 214 may, however, include fewer or more fields for player information.

Player preferences database 216 provides a table of information on player preferences indexed by player identification number. As shown in FIG. 5, database 216 preferably includes the following information on each registered player who entered player preferences through a slot machine: (1) tracking number, (2) game type, (3) language, (4) sound options, (5) speed of reel spins, (6) number of coins played per handle pull, (7) payout structure, (8) payout options, (9) form of complimentaries (comp.), and (10) currency type. Playing preferences generally relates to the values of those parameters that players have selected in establishing their preferred slot machine configuration. The playing preferences contained in database 216 include information about the preferred game (game type), the preferred configuration of the slot machine (language, sound options, speed of reel spins, number of coins played per handle pull), and preferred distribution of awards (payout structure, payout options, form of complimentaries, currency). In practice, fewer or more different types of player preferences can be stored in database 216.

Casino preferences database 218 contains a table of information on casino preferences indexed by player identification number. Casino preferences reflect certain parameters that casinos can adjust according to certain criteria, such as skill level or playing frequency, to maintain the interest of its players. FIG. 6 shows a possible organization for database 218 with the following information on each registered player: (1) hold percentage, (2) complimentary award rate, (3) complimentary award limits, (4) game eligibility (lockout), and (5) other. Hold percentage indicates a range of hold percentages, such as high, medium, and low. Low hold percentages could, for example, be made available to "premium" customers (i.e., those with a high player rating) because those players may be courted by competing casinos.

Complimentary rate indicates how often players should receive complimentary amenities. Complimentary award limit indicates the maximum number or volume of complimentary amenities each player should receive in a given time period (e.g., per night).

Game eligibility indicates whether each player is qualified to play certain games. For example, a casino may reserve particular machines for its most frequent players. Casino preferences database 218 would indicate which players qualify for such games.

The last field labeled "other" contains information representing other variables that can be modified to uniquely customize a game so that the player maintains interest. For example, this field may indicate that the number of player award points accumulated during a certain period of time should be increased by a multiplier to stimulate interest in the player's continued play of the slot machine. Alternatively, the "other" field may contain a stored player gambling history to develop a customized casino preferences and complimentary award program. Such a program would typically be developed to maintain a player's interest in continuing to play a game at a time when the history indicates he may otherwise stop. For example, where the player gambling history indicates that a player typically stops after losing a certain dollar value, the preferences and award program may be designed to improve his odds of winning as he approaches his typical stop value. In alternative embodiments, casino preferences database 218 may include more or fewer fields.

Figure 3:
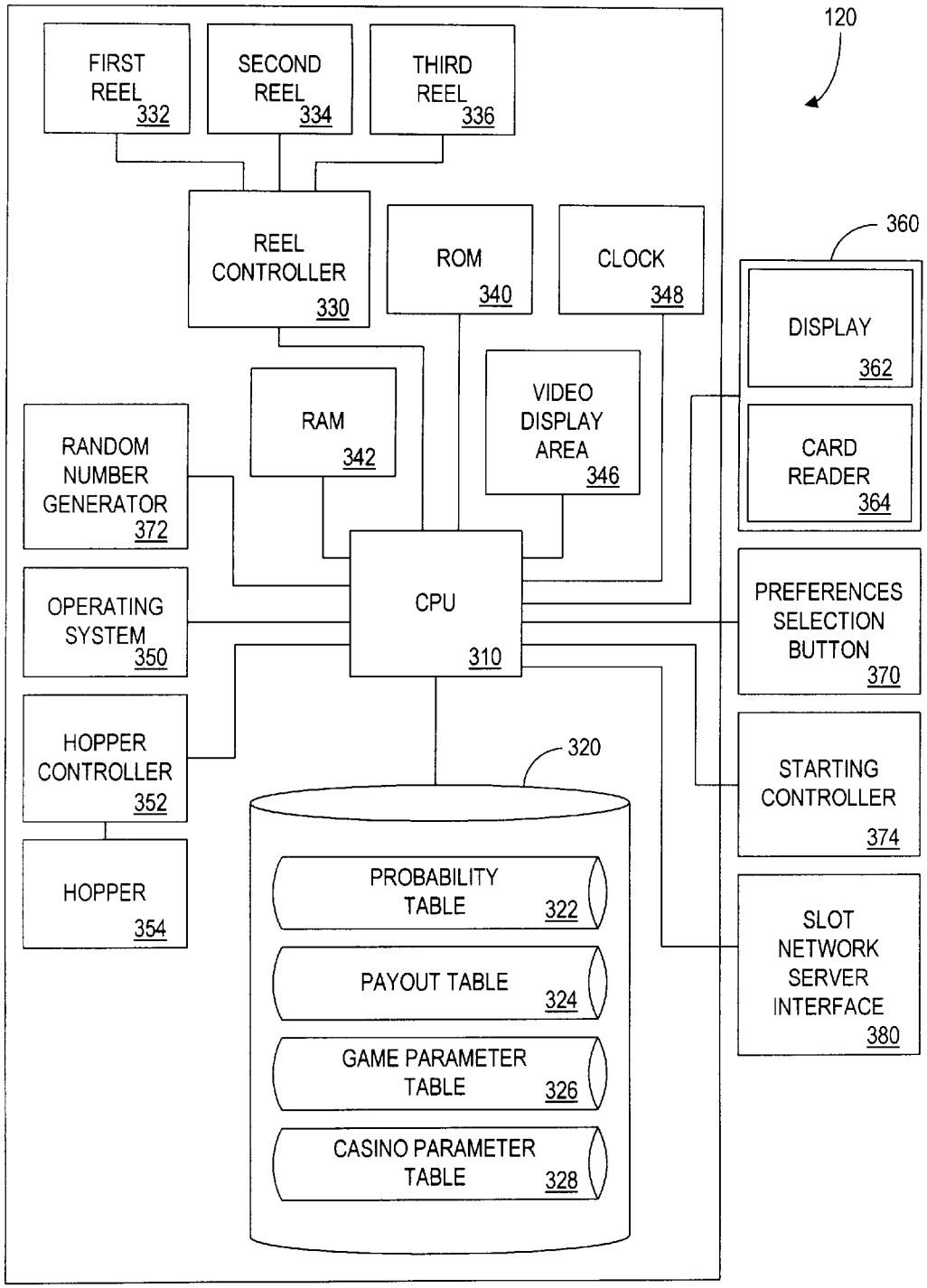
FIG. 3 is a block diagram of slot machine 120 shown in FIG. 1.

FIG. 3 shows the architecture of slot machine 120 according to the invention. Slot network server interface 380 provides a connection for linking slot machine 120 to slot network server 110. As shown in FIG. 3, slot machine 120 includes CPU 310, which is connected to data storage device 320, reel controller 330, ROM 340, RAM 342, video display area 346, clock 348, operating system 350, hopper controller 352, player card tracking device 360, preferences selection button 370, random number generator 372, starting controller 374, and slot network server interface 380. These components may be conventional. CPU 310 executes modules stored in storage device 320 to perform the functions described below. Controller 330 is connected to three reels 332, 334, 336 for displaying symbols corresponding to payouts. Storage device 320 includes probability table 322, payout table 324, game parameters database 326, and casino parameter database 328.

With respect to gaming operations, slot machine 120 operates in a conventional manner. The player starts the machine by inserting a coin, or using electronic credit, and pressing starting controller 374. Under control of a program stored, for example, in storage device 320 or ROM 340, CPU 310 initiates random number generator 372 to generate a number. CPU 310 looks up the generated random number in stored probability table 322 and finds the corresponding outcome. Based on the identified outcome, CPU 310 locates the appropriate payout in the stored payout table 324. CPU 310 also directs reel controller 330 to spin reels 332, 334, 336 and to stop them at a point when they display a combination of symbols corresponding to the generated outcome. When the player wins, the machine stores the credits in RAM 342 and displays them in video display area 346.

Hopper controller 352 is connected to hopper 354 for managing the flow of coins. When the player requests to cash out by pushing a button on slot machine 120, CPU 310 checks RAM 342 to see if the player has any credits and, if so, signals hopper controller 352 to release an appropriate number of coins into a payout tray.

In alternative embodiments, slot machine 120 does not include reel controller 330, and reels 332, 334, 336. Instead, video display area 346 graphically displays simulated representations of objects contained in the selected game, such as graphical reels or playing cards. These representations are preferably animated or displayed to simulate playing of the selected game.

Player card tracking device 360 includes display 362 and card reader 364. Players insert player tracking cards into card reader 364. Tracking cards can be plastic cards with magnetic strips electronically storing respective player identification numbers. Display 362 displays information concerning the use of tracking device 360. Display 362 may be a touch screen display for receiving signals from the player concerning his selection of the options.

Alternatively, machine 120 or device 360 may include one or more separate input buttons (not shown) for the players to select the options and provide other input such as a PIN. Retrieved credits, like those credited during play, are stored locally in the machine's RAM and displayed in the machine's video display area. In other embodiments, slot machine 120 recognizes the identity of players through player identification devices other than player card tracking device 360, thereby eliminating the need for players to carry player identification cards. For example, slot machine 120 could include a keypad, at which players enter either their player identification numbers or their names along with a secured password. Slot machine 120 could also include a device for measuring player biometrics (i.e., fingerprint, voice, or retinal detection) to identify players.

Commercially available player card tracking devices include, for example, the Mastercom device available from Bally Manufacturing. (See, for example, U.S. Pat. No. 5,429,361 to Raven et al.). Such player tracking devices include a magnetic card reader and a numeric keypad for entry of player information.

Preferences selection button 370 allows a player to initiate selection of player preferences and to select player preferences displayed on video display area 346. Button 370 may comprise a conventional input device, such as a keyboard or dedicated buttons marked with appropriate labels.

Game parameter database 326 provides a table of information on game parameters that can be set in slot machine 120. Game parameters generally relate to those parameters that players may want to customize in their game playing.

FIG. 7 shows a possible organization for database 326 with the following information for slot machine 120:(1) game type, (2) language, (3) sound, (4) speed of reel spins, (5) currency, (6) payout type, (7) payout structure, (8) number of coins (default), and (9) form of complimentaries (comp.). Slot machine 120 selects values for each of the parameters from database 326 to configure operation of the game in slot machine 120. Slot machine 120 preferably cannot select values for the parameters that are not contained in database 326. Certain game parameter values stored in database 326 are designated as game default values and may be used when the player does not desire, or has not selected, player preferences. In alternative embodiments, database 326 includes different combinations of fewer or more player parameters.

Casino parameters database 328 provides a table of information on casino parameters that can be set in slot machine 120. Casino parameters generally relate to those parameters affecting awarding of payouts from slot machine 120. FIG. 8 shows a possible organization of database 328 with the following information for slot machine 120: (1) hold percentage, (2) complimentary rate, (3) comp. specifications, (4) game eligibility (lockout), and (5) other. Certain casino parameter values stored in database 328 are designated as game default values and may be used when the casino does not have established casino preferences for a player. Any of the listed casino parameters may be omitted or others included in database 328.

Operation of the System

The operation of system 100 will be described with respect to two different aspects. First, system 100 operates to adapt slot machine 120 to player preferences. Second, system 100 operates to adapt slot machine 120 to casino preferences. These operations may occur concurrently to adapt slot machine 120 to both player and casino preferences.

Adapting to Player Preferences

Figure 9:
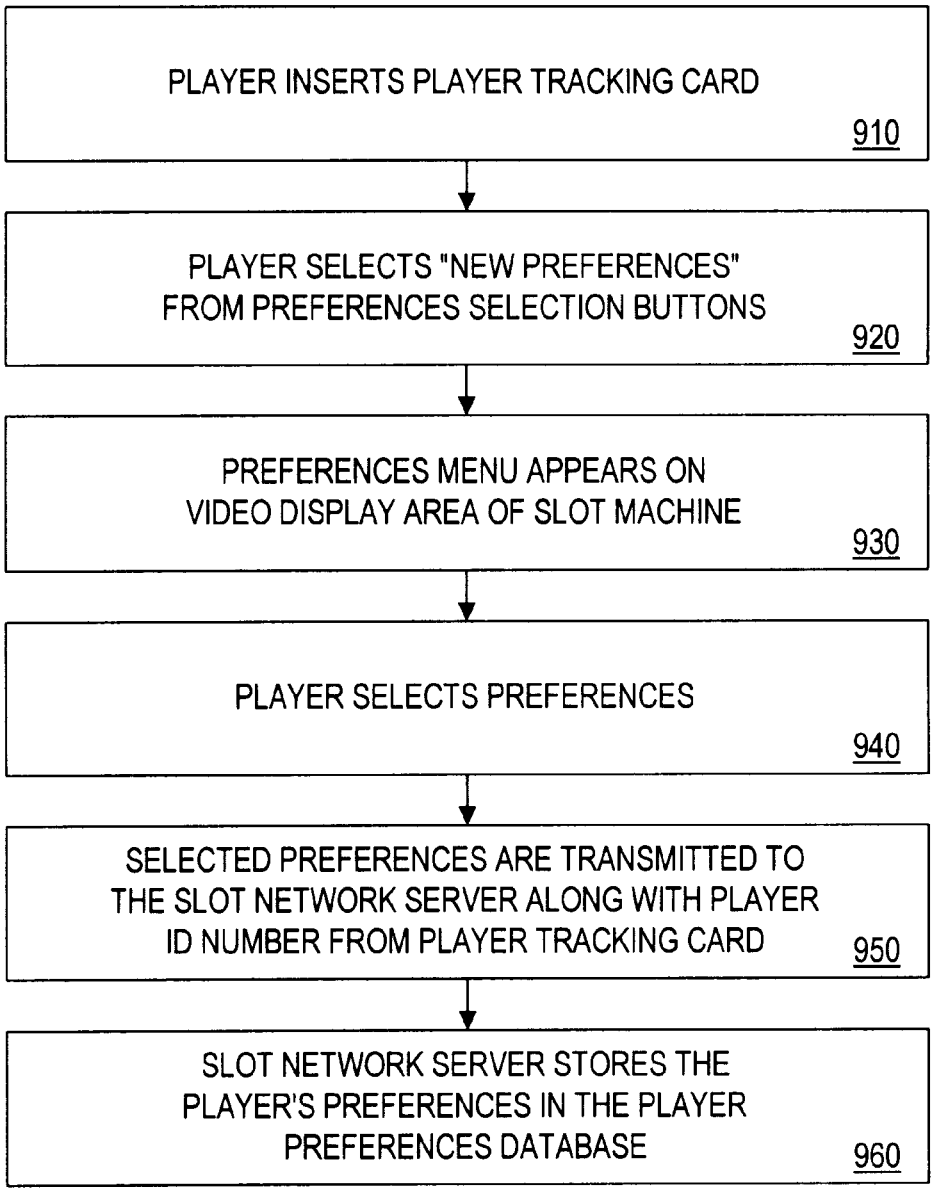
FIG. 9 is a flow diagram representing a method of establishing player preferences in a networked slot machine for later retrieval.

Before slot machine 120 can adapt to player preferences, the player must enter his preferences into system 100. FIG. 9 is a flowchart illustrating the steps in which a player enters his player preferences into system 100. As shown in FIG. 9, the player inserts his player tracking card into slot machine 120 (step 910). The player initiates entry of preferences by pressing the "New Preferences" button from preferences selection buttons 370 (step 920). Video display area 346 displays a preferences menu providing a selection of different choices selectable by the player (step 930). The player selects his preferences using preferences selection button 370 (step 940), and slot machine 120 transmits the selected preferences, along with the player's identification number from his player tracking card, to slot network server 110 (step 950). Slot network server 110 stores the player's preferences in player preferences database 216 for later retrieval (step 960).

Figure 10A:
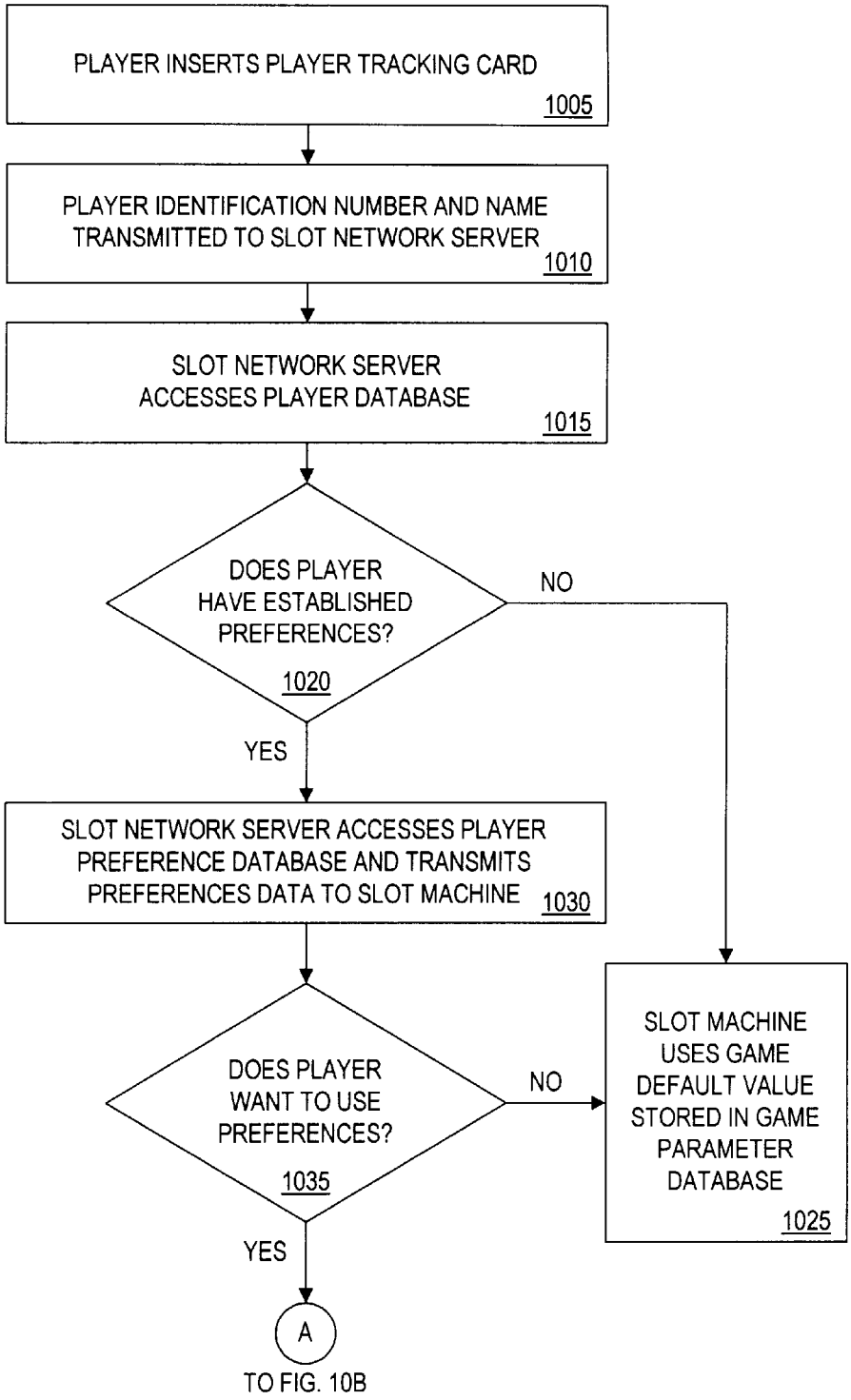
FIGS. 10*a*–10*b* are flow diagrams representing a method of configuring a slot machine based upon player preferences consistent with the invention.

Once a player has selected his preferences, he may later retrieve them for configuring slot machine 120. FIGS. 10*a*–10*a* illustrate the manner in which system 100 retrieves player preference data to configure slot machine 120. As shown in FIG. 10*a*, the player inserts player tracking card into slot machine 120 (step 1005), and slot machine 120 transmits the player identification number to slot network server 110 (step 1010). Although not shown, slot network server 110 may validate the player identification number by requiring that the player enter a PIN into slot machine 120.

Next, server 110 accesses the player database 214 (step 1015) and determines whether the player has previously established player preferences (step 1020). If not, server 110 informs slot machine 120, which retrieves game default values stored in game parameter database (step 1025). If the player does have established preferences (step 1020), slot network server 110 accesses player preference database 216 and transmits the preferences data corresponding to that player's identification number to slot machine 120 (step 1030).

In one embodiment, server 110 transmits data actually representing the player preferences. In an alternative embodiment, server 110 transmits codes representing the player preferences, in which case slot machine 120 translates the received codes into player preferences using game parameter database 326.

Slot machine 120 then queries the player whether to use previously established player preferences (step 1035). If not, slot machine 120 uses game default values stored in game parameter database 326 (step 1025). If the player indicates a desire to use his player preferences, slot machine 120 overrides the game default values and configures the game in slot machine 120 to match the player preferences (step 1040). Alternatively, slot machine 120 configures the game to the players preferences without any input from the player.

Figure 10B:
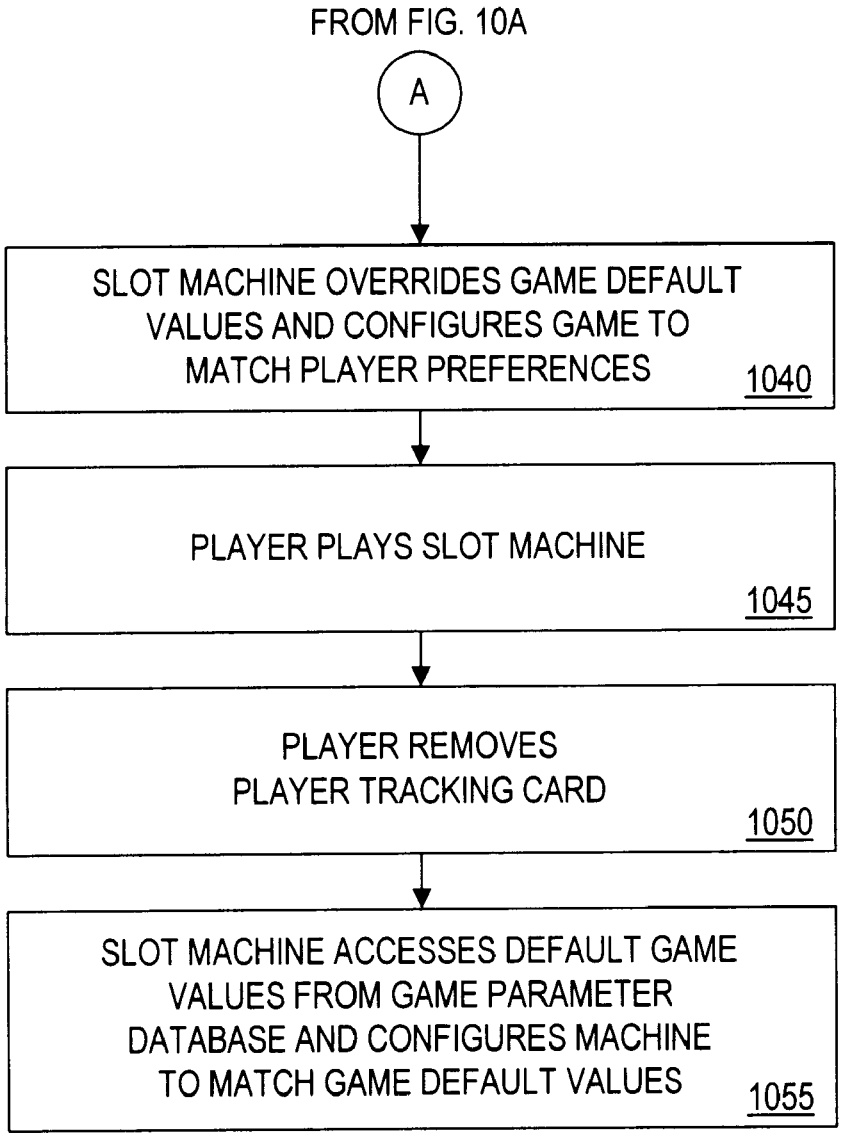

Continuing to FIG. 10*b*, now that slot machine 120 is configured, the player plays the game on slot machine 120 (step 1045). When the player finishes, he removes the player tracking card from slot machine 120 (step 1050). Upon removal of the player tracking card, slot machine 120 accesses default game values from game parameter database 326 and configures the game in slot machine 120 to match the game default values (step 1055).

Adapting to Casino Preferences

Figure 11A:
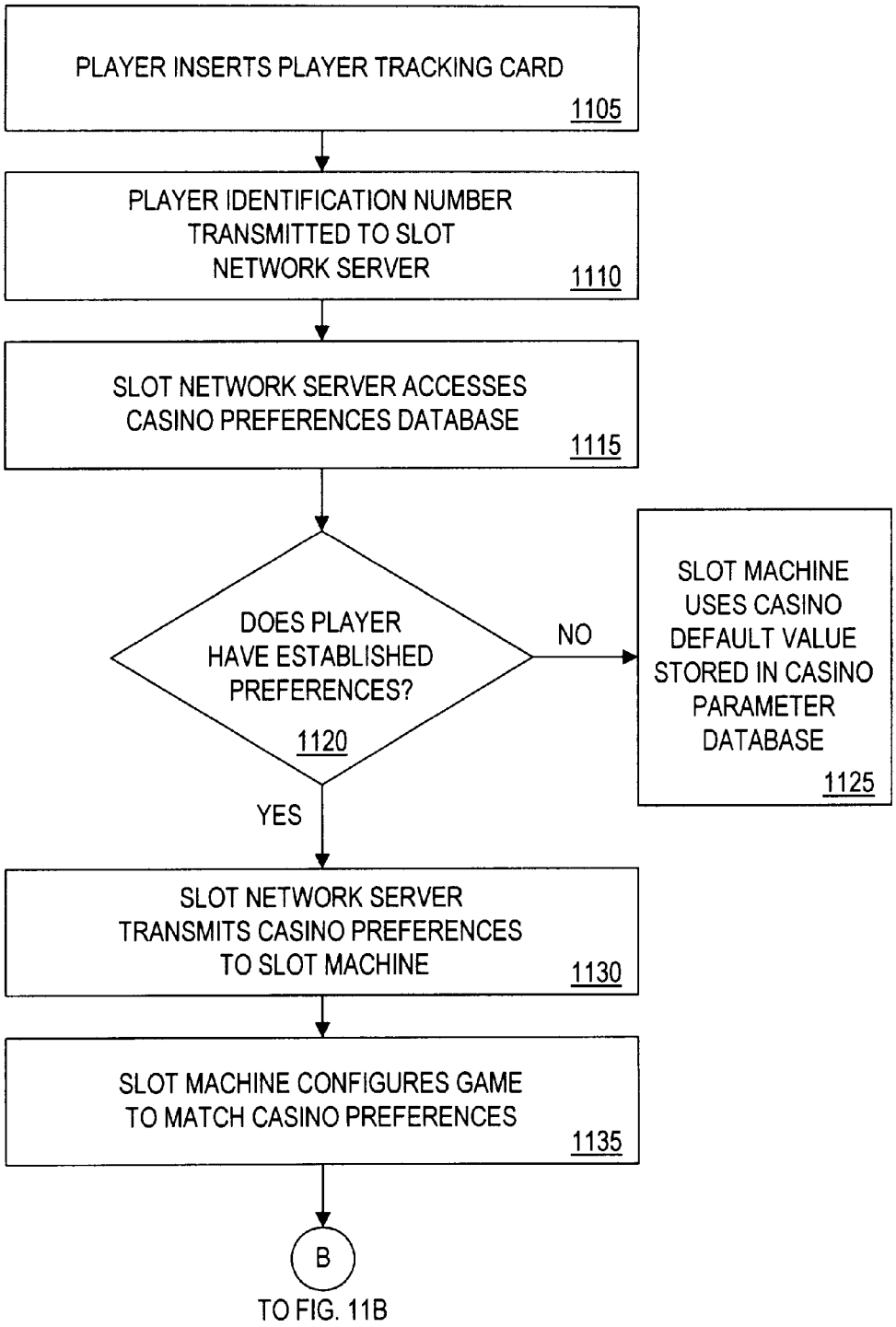

FIGS. 11*a*–1*b* illustrate the manner in which system 100 configures slot machine 120 to adapt to casino preferences. As shown in FIG. 11*a*, after the player inserts his player tracking card into slot machine 120 (step 1105), slot machine 120 transmits the player identification number to slot network server 110 (step 11 10). Slot network server 110 accesses casino preferences database 218 (step 1115), and determines whether the player has established casino preferences (step 1120). If not, slot machine 120 uses casino default values stored in casino parameter database 328 (step 11 25). If so, s lot network server 110 transmits casino preferences to slot machine 120 (step 1130).

In one embodiment, server 110 transmits data representing the casino preferences. In another embodiment, server 110 transmits codes representing the casino preferences, in which case slot machine 120 translates the codes into the casino preferences using casino parameter database 328. Slot machine 120 configures the game to match the received casino preferences (step 1135).

Figure 11B:
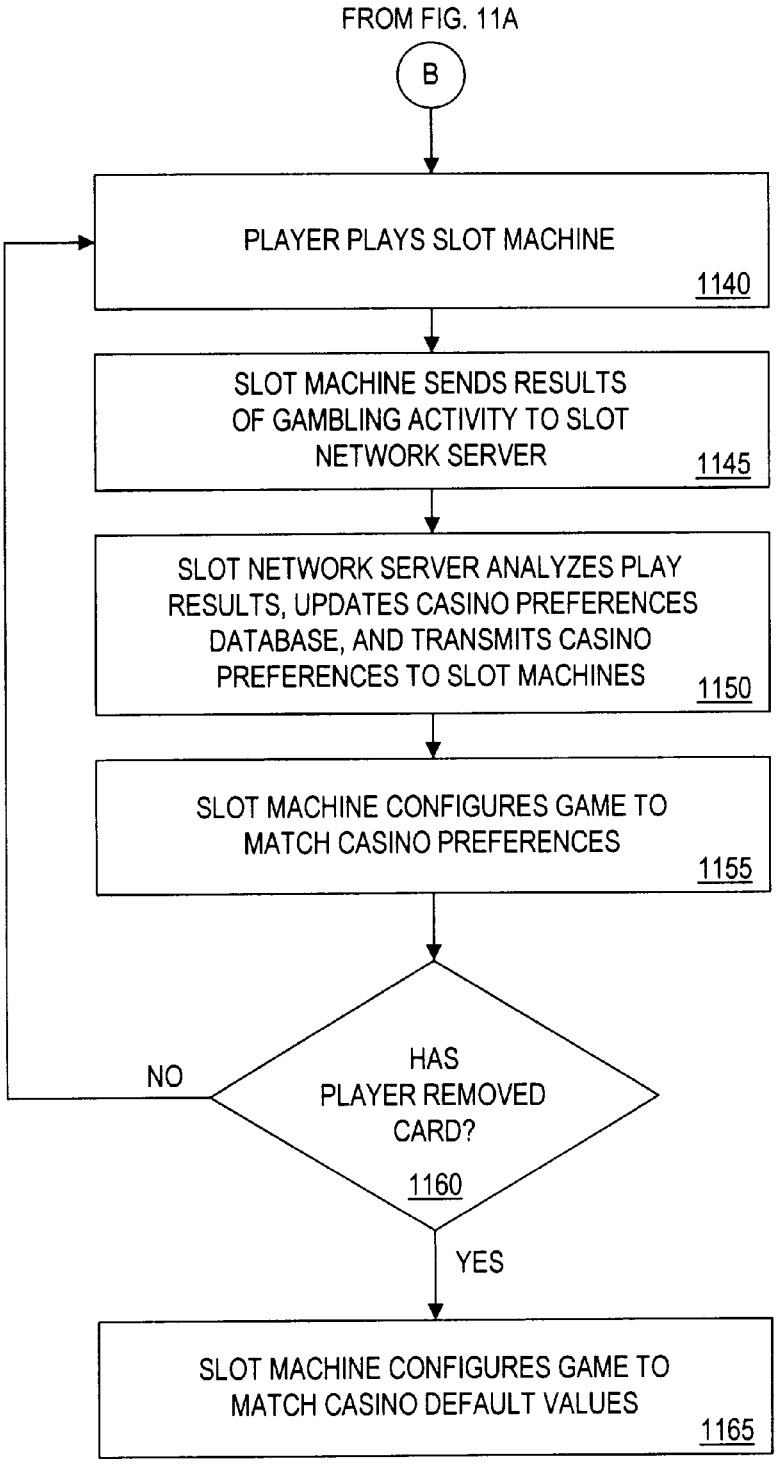

Continuing to FIG. 11*b*, the player plays slot machine 120, as configured above. (step 1140). The slot machine sends the results of the gambling activity (i.e., the amount of money spent by the player and the amount of money won by the player) to slot network server 110 (step 1145). Slot network server 110 analyzes the play results; updates casino preferences database 216 as necessary; and transmits the updated casino preferences to slot machine 120 (step 1150).

Server 110 preferably establishes casino preferences by applying the received play results to predetermined rules. These rules may consider, for example, the skill of the player or the amount of money spent before the player quits. These rules are preferably designed to adjust casino parameters to stimulate the player's interest in continuing to play slot machine 120. Server 110 also calculates and stores any complimentary awards due the player.

Slot machine 120 next configures the game to match the received casino preferences (step 1155), and determines whether the player has removed his card (step 1160). If not, steps 1140–1155 are repeated. If the player has removed his card, slot machine 120 configures the game to match casino default values (step 1165).

Alternative Embodiments

Although the system of the invention has been described as one or more slot machines networked to a central server, the invention applies to other game s a nd gaming environment s. For example, the invention can be applied to table games, such as black jack and craps. Players insert their player tracking cards into card readers corresponding to seats around, for example, a black jack table. The central server could access player preferences d at a and casino preferences data for the players, and transmit that data to a data terminal located at the dealer. The dealer could then modify the game or award payouts according to the preferences.

The invention also could apply to other environments or systems involving one or more data terminals networked to a central server to configure the terminals to identifiable users or operators. For example, the invention could be readily modified to apply to networked video game systems, systems with point-of-sale terminals, and automatic teller machines (ATM). This eliminates the need for users or operators to manually enter information during each and every session to configure the terminal.

Further, player preferences data m ay be stored entirely on the player tracking card, rather than a central server. In such an embodiment, a machine reads the player preferences data from a received player tracking card and stores updated player preferences data on the card. In this way, player preferences move from machine to machine with the player's use of the card. Casino preferences may be added to the card periodically by, for example, temporarily providing the card to casino personnel for this purpose.

Conclusion

It will be apparent to those skilled in the art that various modifications and variations can be made in the method and system of the present invention without departing from the spirit or scope of the invention. For example, the databases described above may reside in one or more databases stored in the data storage devices of either slot machine 120 or slot network server 110. The present invention covers the modifications and variations of this invention provided they come within the scope of the appended claims and their equivalents.

What is claimed is:

1. A gaming system adaptable to playing preferences, comprising:

a slot machine for allowing a player to bet on pseudo-randomized events, said slot machine including means for receiving player preference data representing a preferred operation of said slot machine; and means for programming said slot machine to operate according to said received Player preference data, and a central server including:

means for storing a collection of data representing various operations of said slot machine; and means for selectively transmitting a portion of said stored collection of data to said slot machine as player preference data in response to receiving player identification data.

2. The system according to claim 1, wherein said slot machine further comprises:

means for receiving the player identification data; and means for transmitting said received player identification data to said central server.

3. The system according to claim 2, wherein said means for storing comprises means for indexing said collection of data according to player Identification data; and wherein said means for selectively transmitting comprises means for selecting a portion of said stored collection of data corresponding to said received player identification data and for transmitting the selected portion as the player preference data.

4. The system according to claim 3, wherein said means for storing comprises means for indexing said collection of data according to player identification data; and wherein said means for selectively transmitting comprises means for selecting a portion of said stored collection of data corresponding to said received player identification data and for transmitting the selected portion as player preference data.

5. The system according to claim 2, wherein said central server further comprises means for progressively accumulating player reward points associated with said player identification data according to amounts that said player bets on said slot machine and said preference data.

6. The system according to claim 5, wherein said central server further comprises means for transmitting said accumulated player reward points to said slot machine, and wherein said slot machine comprises means for receiving said transmitted accumulated player reward points and for displaying said received accumulated player reward points.

7. The system according to claim 1, wherein said slot machine further comprises means for monitoring said player's play results, and means for transmitting result data representing said player's monitored results to said central server.

8. The system according to claim 7, wherein said central server further comprises means for receiving said result data from said slot machine.

9. The system according to claim 8, wherein said server further comprises means for establishing casino preferences according to said result data and for storing data representing the established casino preferences for that player.

10. The system according to claim 9, wherein said means for selectively transmitting comprises means for selecting a portion of said stored collection of data corresponding to the established casino preferences.

11. The system according to claim 1, wherein said means for selectively transmitting comprises means for determining a payout type according to said received player preference data.

12. The system according to claim 11, wherein said means for determining a payout type includes means for determining that said payout type is at least one of cash, increased player reward points, a prize, a complimentary amenity, and a discount coupon.

13. A server for configuring a slot machine to playing preferences, comprising:

means for storing a collection of data representing various operations of said slot machine;

means for selectively transmitting a portion of said stored collection of data to said slot machine as preference data; and means for receiving a player identification number and for retrieving a portion of said stored collection of data corresponding to the received player identification number as player preference data for that player in response to receiving the player identification number.

14. The server according to claim 13, wherein the means for selectively transmitting comprises means for transmitting said player preference data to said slot machine.

15. The server according to claim 13, further comprising means for determining whether a portion of said stored collection of data corresponds to established casino preferences for that player, and means for retrieving said portion of said stored collection of data as casino preference data in response to receiving the player identification number.

16. The server according to claim 15, wherein the means for selectively transmitting comprises means for transmitting said casino preference data to said slot machine.

17. The server according to claim 13, further comprising means for receiving play results of said player and for establishing casino preferences based upon the received play results.

18. The server according to claim 17, further comprising means for transmitting said casino preferences to said slot machine as casino preference data.

19. A game machine, adaptable to playing preferences, for allowing a player to bet on pseudo-randomized events controlled by the game machine, comprising:

means for receiving player preference data representing a player's preferred operation of said game machine from an electronic storage medium; and means for configuring said game machine to operate according to said received player preference data in response to receiving a player identifier corresponding to the player preference data.

20. The game machine according to claim 19, wherein said electronic storage medium comprises a magnetically-encoded card.

21. The game machine according to claim 19, wherein said electronic storage medium comprises a remote electronic server.

22. The game machine according to claim 19, further comprising means for receiving a player tracking card containing a player identification number and means for transmitting the player identification number to said networked server.

23. The game machine according to claim 22, wherein said means for receiving player preference data comprises means for receiving player preference data corresponding to game parameters of said game machine.

24. The game machine according to claim 22, wherein said means for receiving player preference data includes means for receiving casino preference data corresponding to casino parameters for said game machine.

25. The game machine according to claim 22, further comprising means for storing default game parameter values and default casino parameter values.

26. The game machine according to claim 25, further comprising means for configuring said game machine to operate according to said default game parameter values and default casino parameter values if said means for receiving preference data does not receive any preference data.

27. A method of entering preference data into a gaming system, comprising the steps, executed by a game machine, of:

receiving a player tracking card;

reading a player identification number from the player tracking card; receiving player preference data; and transmitting the received player preference data and the player identification number to a remote server for storage in response to reading the player identification number.

28. The method according to claim 27, further comprising the step of storing the transmitted player preference data in said server.

29. The method according to claim 27, further comprising the step of displaying a menu containing parameter values from which a player can select the player preference data.

30. An article of manufacture for causing a device to store player preference data in a gaming system, comprising:

means for causing a device to receive a player tracking card;

means for causing a device to read a player identification number from the player tracking card;

means for causing a device to receive a player preference data; and means for causing a device to transmit the received player preference data and the player identification number to a remote server for storage in response to the transmission of the player identification number.

31. A method of configuring a slot machine according to player preferences, comprising the steps, executed by the slot machine, of: receiving a player tracking card;

reading a player identification number from the player tracking card; transmitting the player identification number to a remote server;

receiving player preference data corresponding to the player identification number; and configuring the slot machine according to the received player preference data in response to the transmission of the player identification number.

32. The method according to claim 31, further comprising the steps of:

allowing a player to play at least one game on the slot machine;

surrendering the player tracking card to the player;

accessing game default values; and configuring said slot machine according to said game default values.

33. An article of manufacture for causing a device to configure a slot machine according to player preferences, comprising: means for causing a device to receive a player tracking card;

means for causing a device to read a player identification number from the player tracking card;

means for causing a device to transmit the player identification number to a remote server;

means for causing a device to receive a player preference data corresponding to the player identification number; and means for causing a device to configure a slot machine according to the received player preference data in response to the transmission of the player identification number.

34. A method of configuring a slot machine to casino preferences, comprising the steps, executed by the slot machine, of:

receiving a player tracking card;

reading a player identification number from the player tracking card; transmitting the player identification number to a remote server;

receiving player preference data and casino preference data corresponding to the player identification number; and configuring the slot machine according to the received player and casino preference data in response to the transmission of the player identification number.

35. The method according to claim 34, further comprising the steps of:

allowing a player to play at least one game on said slot machine;

transmitting play results from said slot machine to said remote server;

receiving updated casino preference data;

configuring said slot machine according to said updated casino preference data.

36. The method according to claim 35, further comprising the steps of:

surrendering said player tracking card; and configuring said slot machine to casino default values.

37. An article of manufacture for causing a device to configure a slot machine to casino preferences, comprising:

means for causing a device to receive a player tracking card;

means for causing a device to read a player identification number from the player tracking card;

means for causing a device to transmit the player identification number to a remote server;

means for causing a device to receive player preference data and casino preference data corresponding to the player identification number; and means for causing a device to configure the slot machine according to the received player and casino preference data in response to the transmission of the player identification number.

38. A system comprising:

at least one gaming device; and a server coupled to the gaming device, wherein the server is operable to store at least one player preference associated with a player identifier, and wherein the server is operable to configure the gaming device to implement the player preference on the gaming device in response to receiving the player identifier.

39. The system of claim 38 wherein the server is further operable to store at least one casino preference associated with the player identifier, and wherein the server is operable to configure the gaming device to implement the casino preference on the gaming device in response to receiving the player identifier.

40. The system of claim 38 wherein the player preference defines at least one value of at least one game parameter.

41. The system of claim 39 wherein the casino preference defines at least one value of at least one game parameter.

42. A method comprising the steps of: receiving a player identifier; and configuring a gaming device to implement a player preference associated with the player identifier in response to receiving the player identifier.

43. A method comprising the steps of:

storing, in a server, at least one player identifier and at least one associated player preference defining a preferred configuration of a gaming device coupled to the server;

receiving the player identifier; and configuring the gaming device to implement the player preference associated with the received player identifier in response to receiving the player identifier.

* * * * *

UNITED STATES PATENT AND TRADEMARK OFFICE

CERTIFICATE OF CORRECTION

PATENT NO. : 6,110,041
APPLICATION NO. : 08/775388
DATED : August 29, 2000
INVENTOR(S) : Jay S. Walker, James A. Jorasch and Thomas M. Sparico It is certified that error appears in the above-identified patent and that said Letters Patent is hereby corrected as shown below:

Please REPLACE the paragraph starting at Column 1, Line 5, immediately following the heading "RELATED APPLICATIONS" with the following REPLACEMENT PARAGRAPH:

This application is a continuation-in-part of and claims priority to U.S. Patent Application Serial No. 08/635,576 filed on April 22, 1996 and issued as U.S. Patent No. 5,779,549 on July 14, 1998 to Walker et al., and entitled "Database Driven Online Distributed Tournament System".

Signed and Sealed this
Twelfth Day of July, 2011

David J. Kappos

David J. Kappos
*Director of the United States Patent and Trademark Office*

US006110041C1

(12) EX PARTE REEXAMINATION CERTIFICATE (10407th)

United States Patent
Walker et al.

(10) Number: US 6,110,041 C1
(45) Certificate Issued: Nov. 17, 2014

(54) METHOD AND SYSTEM FOR ADAPTING GAMING DEVICES TO PLAYING PREFERENCES

(75) Inventors: Jay S. Walker, Ridgefield, CT (US); James A. Jorasch, Stamford, CT (US); Thomas M. Sparico, Riverside, CT (US)

(73) Assignee: Walker Digital, LLC, Stamford, CT (US)

Reexamination Request:
No. 90/012,333, May 31, 2012

Reexamination Certificate for:

| | |
|---|---|
| Patent No.: | **6,110,041** |
| Issued: | **Aug. 29, 2000** |
| Appl. No.: | **08/775,388** |
| Filed: | **Dec. 30, 1996** |

(51) Int. Cl.
*A63B 71/00* (2006.01)

(52) U.S. Cl.
USPC ..... 43/20; 463/42; 273/139

(58) Field of Classification Search
None
See application file for complete search history.

(56) References Cited

To view the complete listing of prior art documents cited during the proceeding for Reexamination Control Number 90/012,333, please refer to the USPTO's public Patent Application Information Retrieval (PAIR) system under the Display References tab.

*Primary Examiner* — Mark Sager

(57) ABSTRACT

A slot machine networked to a central server receives preference data corresponding to a player from the central server and configures the game to match the received preference data. The player inserts his player tracking card into the slot machine, which transmits player identification data to the central server. The central server transmits player preference data and casino preference data for that player to the slot machine for configuration. While the player plays the slot machine, the slot machine transmits data about the player's performance to the central server. The central server determines appropriate casino preference values based upon the player's performance and transmits those values to the slot machine for configuration.

EX PARTE REEXAMINATION CERTIFICATE ISSUED UNDER 35 U.S.C. 307

THE PATENT IS HEREBY AMENDED AS INDICATED BELOW.

AS A RESULT OF REEXAMINATION, IT HAS BEEN DETERMINED THAT:

Claims 38, 40 and 42-43 are cancelled.

Claims 1-37, 39 and 41 were not reexamined.

* * * * *